US009917356B2

(12) United States Patent
Jeon et al.

(10) Patent No.: US 9,917,356 B2
(45) Date of Patent: Mar. 13, 2018

(54) BAND-NOTCHED SPIRAL ANTENNA

(71) Applicants: Jae Jeon, Livermore, CA (US); John Chang, Danville, CA (US)

(72) Inventors: Jae Jeon, Livermore, CA (US); John Chang, Danville, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 273 days.

(21) Appl. No.: 14/027,132

(22) Filed: Sep. 13, 2013

(65) Prior Publication Data

US 2015/0077308 A1 Mar. 19, 2015

(51) Int. Cl.
*H01Q 1/36* (2006.01)

(52) U.S. Cl.
CPC ..... *H01Q 1/36* (2013.01)

(58) Field of Classification Search
CPC ..... H01Q 1/36
USPC ..... 343/895
See application file for complete search history.

(56) References Cited

U.S. PATENT DOCUMENTS 4,243,993 A * 1/1981 Lamberty ..... H01Q 11/083 343/895
4,945,363 A * 7/1990 Hoffman ..... H01Q 11/083 343/895
5,621,422 A * 4/1997 Wang ..... H01Q 1/36 343/700 MS
6,501,364 B1 * 12/2002 Hui ..... H01F 27/365 336/200
2003/0016184 A1 * 1/2003 Kitching ..... H01Q 1/362 343/895

OTHER PUBLICATIONS

Jung, et al., "Tilt Beam Characteristics by Changing Length of Finite-Sized Square Dielectric Substrate of One Arm Rectangular Spiral Antenna", Department of Electrical and Computer Engineering Univsersity of California, 4 pages.
Ammann, "Square Planar Monopole Antenna", National Conference on Antennas and Propagation: Conference Publication No. 461, pp. 37-40 (Apr. 1, 1999).
Lee, et al., "Wideband Planar Monopole Antennas With Dual Band-Notched Characteristics", IEEE Transactions on Microwave Theory and Techniques, vol. 54, pp. 2800-2806 (Jun. 6, 2006).
Dahalan, et al., "Archimedean Spiral Anetanna with Band-Notched Characteristics", Progress in Electromagnetics Research C, vol. 37, pp. 83-94 (2013).

* cited by examiner

*Primary Examiner* — Dameon E Levi
*Assistant Examiner* — Walter Davis
(74) *Attorney, Agent, or Firm* — James S. Tak

(57) ABSTRACT

A band-notched spiral antenna having one or more spiral arms extending from a radially inner end to a radially outer end for transmitting or receiving electromagnetic radiation over a frequency range, and one or more resonance structures positioned adjacent one or more segments of the spiral arm associated with a notch frequency band or bands of the frequency range so as to resonate and suppress the transmission or reception of electromagnetic radiation over said notch frequency band or bands.

18 Claims, 13 Drawing Sheets

BAND-NOTCHED SPIRAL ANTENNA

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

This patent document relates to spiral antennas and more particularly to a band-notched spiral antenna having resonant structures adjacent corresponding sections of the spiral arm of the antenna associated with a notch frequency band, for suppressing the notch frequency band from the antenna's operating bandwidth.

BACKGROUND

Broadband systems (including wideband and ultra wideband (UWB)) operate over a broad frequency spectrum which may cause interference to or experience interference from narrow-band systems operating in a portion of the frequency range of the broadband system. For example, ultra-wideband (UWB) is defined as a bandwidth greater than 500 MHz or 20% of the arithmetic center frequency, and the Federal Communications Commission (FCC) designated 3.1-10.6 GHz for unlicensed uses by UWB systems. Due to its wide band characteristics, UWB systems are susceptible to possible interference from other systems utilizing a subset of or partially overlapping frequency spectrum. Most notably for UWB, one such example is the IEEE 802.11a band, which spans from 5.15 to 5.825 GHz.

In order to enable such broadband systems to share a portion of the spectrum with a narrow-band system, band notching techniques have been implemented to notch out the band occupied by the narrow-band system. Traditional band-notching techniques have involved the use of a notch filter (aka band-stop filter or band-rejection filter) to reject unwanted frequency content, designing component filters into the broadband system, and integrating a notch filter into the broadband antenna itself. For planar microstrip monopole antennas in broadband systems, however, one general approach has been to produce notch filter characteristics without the use of traditional notch filters by creating an additional resonance on the antenna at the unwanted frequency to suppress a notch frequency range. Variously shaped structures and their purposeful placement within the radiating sections of the monopole antenna that yields secondary resonance have been implemented, providing a notch filter response over a frequency band of interest. Such structures can take form of slots or additional radiating elements in various shapes within the radiating sections of the antenna. One example band-notching technique for planar monopole antennas is disclosed in the paper "Wideband Planar Monopole Antennas with Dual Band-Notched Characteristics" by Wang-Sang Lee et al (2006, IEEE).

Similar band-notching techniques are known for spiral antennas which are, similar to planar monopole antennas, broadband antennas having a very large frequency spectrum bandwidth for broad band performance. However, some of the advantages of spiral antennas include their ability to be designed to cover the same frequency band as planar monopole antennas while having a comparable or smaller footprint, and generating circularly polarized electromagnetic waves in obi-directional radiation pattern orthogonal to the plane of the antenna. And well-designed spiral antennas can have return loss of less than 2:1 VSWR over broad frequency band. One example band-notching technique for spiral antennas is described in the paper "Archimedean Spiral Antenna with Band-Notched Characteristics" by Dahalan et al (2013, Progress in Electromagnetics Research) where inverted U-shaped slots are embedded in the feed line connecting to one of the two spiral arms.

SUMMARY

One aspect of the present invention includes a band-notched spiral antenna, comprising: a spiral arm extending from a radially inner end to a radially outer end for transmitting or receiving electromagnetic radiation over a frequency range; and a resonance structure positioned adjacent a segment of the spiral arm associated with a notch frequency band of the frequency range so as to resonate and suppress the transmission or reception of electromagnetic radiation over said notch frequency band.

Another aspect of the present invention includes a band-notched spiral antenna, comprising: two spiral arms extending between a radially inner end to a radially outer end for transmitting or receiving electromagnetic radiation over a frequency range; and for each spiral arm, a resonance structure having a partial spiral shape substantially similar to a segment of the spiral arm associated with electromagnetic radiation of a notch frequency band of the frequency range and positioned adjacent to and co-extending substantially in parallel with the spiral arm segment to resonate and suppress electromagnetic radiation over said notch frequency band.

And another aspect of the present invention includes a band-notched spiral antenna, comprising: a substrate; at least two spiral arms formed on the substrate and extending between a radially inner end to a radially outer end for transmitting or receiving electromagnetic radiation over a frequency range; and for each spiral arm, at least two resonance structures formed on an opposite side of the substrate from the spiral arms, with each resonance structure having a partial spiral shape substantially similar to a corresponding one of at least two segments of the spiral arm associated with electromagnetic radiation of at least two notch frequency bands of the frequency range and positioned adjacent to and co-extending substantially in parallel with the corresponding one of the at least two spiral arm segments to resonate and suppress electromagnetic radiation over said at least two notch frequency bands.

Other aspects of the present invention may include in addition to the above aspects one or more of the following: wherein the resonance structure has a partial spiral shape substantially similar to and co-extending substantially in parallel with the spiral arm segment; wherein the resonance structure is electrically connected to the spiral arm segment by an electrically conductive via; wherein the via connects a downstream end of the resonance structure to a corresponding downstream end of the spiral arm segment so that the resonance structure co-extends with the spiral arm segment from the downstream end to an upstream end adjacent a corresponding upstream end of the spiral atm segment; wherein the resonance structure is positioned adjacent the spiral arm segment by a standoff insulator connecting between the resonance structure and the spiral arm segment; wherein the resonance structure is positioned adjacent the spiral arm segment so that an orthogonal projection of the resonance structure onto the spiral arm does not intersect other segments of the spiral arm radially adjacent to the spiral arm segment; further comprising at least one additional resonance structure each positioned adjacent another segment of the spiral arm associated with electromagnetic radiation of another notch frequency band of the frequency range so as to resonate and suppress electromagnetic radiation over said another notch frequency band; further comprising: at least one additional spiral arm extending between the other spiral arm(s) from a radially inner end to a radially outer en, and for each additional spiral at in, a resonance structure positioned adjacent a segment thereof associated with electromagnetic radiation of said notch frequency band; for each spiral arm, at least one additional resonance structure each positioned adjacent another segment of said spiral arm associated with electromagnetic radiation of another notch frequency band of the frequency range so as to resonate and suppress electromagnetic radiation over said another notch frequency band; further comprising: a substrate for supporting the spiral arm and the resonance structure thereon; and wherein the resonance structure is formed on an opposite side of the substrate from the spiral arm.

The present invention is generally directed to a band-notched spiral antenna which may be used for broadband, wideband, ultra-wideband (UWB) or multiband wireless communication systems, radars, wireless sensors, etc. In particular, the band-notched spiral antenna has one or more spiral arms (or strips) of a conductive material (e.g. metal) extending from a radially inner end to a radially outer end for transmitting or receiving electromagnetic radiation over a frequency range (e.g. RF range). Additionally for each spiral arm, one or more resonant structures also of an electrically conductive material is positioned adjacent one or more segments of the spiral arm corresponding to one or more target frequency bands ("notch frequency bands") of the frequency range to create a notch-band effect in the performance of the spiral antenna by resonating and suppressing (i.e. notching out from the operating frequency range) the transmission and/or reception of electromagnetic radiation over the notch frequency band. The physical location of radiation along the spiral arms varies with frequency because, according to band theory, as current travels down the spiral arms radiation occurs at the point where distance becomes one wavelength. Thus by determining the unique radiation locations for all frequencies capable of being transmitted or received by the spiral arms of the antenna, the resonance structures may be selectively positioned adjacent those spiral arm locations to produce frequency selective suppression of electromagnetic radiation at the frequency of interest while preserving flat return loss profile outside of the notch band.

Various types of spiral curvatures may be used for the spiral arms/strips of the present invention, such as for example Archimedean, equiangular, etc. One example spiral structure of the spiral arm of the present invention is an equiangular spiral which is completely described by angles, as used in a planar equiangular spiral antenna (PESA) embodiment. It is this property that gives frequency independent characteristics if the antenna were to expand out to infinity. In practice, PESAs are limited in size, which in turn limits the low end of the operating frequency range. The upper end of the operating frequency range is set by the proximity of the two arms at the feed point (which may be at a radially inner end of the spiral or at a radially outer end of the spiral. In any case, spacing between strips, metal strip width (i.e. girth), number of turns, initial and final radius may be particularly designed to produce a desired antenna performance.

Furthermore, the spiral arms of the spiral arms of the present invention may be formed as 2D spirals (i.e. where the spiral arms grow in only two dimensions) to form planar spiral antennas, or in the alternative may be formed as 3D spirals, such as for example having a conical (hollow or solid) configuration, pyramidal (hollow or solid) configuration, etc. For ease and low cost of manufacturing, planar spiral antennas are typically printed onto substrates using standard PCB fabrication processes. In this case, the substrate may be considered a part of the spiral antenna construction if not otherwise separated and removed from the spiral arm. It is also appreciated that the spiral arm may be formed as a free-stranding construction, such as upon removing the substrate after use as a fabrication scaffold. It is appreciated that if a substrate is used, the spiral arms (and resonance structures) may be formed directly or indirectly on the substrate so as to be supported by the substrate, where direct formation contacts the substrate directly, while indirect formation on the substrate may utilize intermediate layers, such as in a multilayer construction. And in the case where the spiral arms are formed as free-standing structures, the resonance structures may be connected to and positioned along segment of free-standing spiral antenna via a dielectric standoff structure, and if a via is used to electrically connect the resonance structure to the arm, the via is arranged to traverse the standoff insulator.

The resonance structure or structures (e.g. electrically conductive strips) positioned to suppress target frequency band may have a partial spiral shape that is substantially similar to and co-extending substantially in parallel with and spaced from the target spiral arm segment. If a substrate is used to print or otherwise form the spiral arm or arms, the resonance structure or structures may formed on an opposite side of the substrate, or in the alternative on the same side of the substrate as the spiral arms. It is appreciated that in the latter case, the resonance structures may be spatially offset from the spiral arms by means of a standoff insulator structure connective between the arm and resonance structure. The length and position of the resonance structure is selected to cover and overlap the complete section of the spiral arm associated with the notch frequency band, and therefore determines the bandwidth that is suppressed. Two degrees of freedom in defining the location and the dimensions/shape (including width and length) of the resonant structure can be used to control the center frequency and the bandwidth of the notch-band. With regard to the width, i.e. girth, of resonance structure, the resonance structure (i.e. the orthogonal projection of the resonance structure onto the spiral arm plane) should not cross any other part of the spiral arm, which can cause interference. Therefore, the girth of the resonance structure may be delimited by the spacing between radially-adjacent spiral sections, i.e. maximum girth of resonance structure may be selected to be the distance between alternating radially-adjacent sections of spiral antenna on opposite sides of a corresponding spiral segment. While the girth of the resonance structure does not have to be exactly the same width as the main spirals, it affects the suppression level in the notch band.

Vias may also be provided electrically connecting the spiral arm segment to the adjacent positioned resonance structure. While the resonance structures alone create resonance and suppression of the transmission and/or reception of EM radiation, the addition of vias/conductive connections between spiral arms and resonance structure can enhance the performance of rejection in the notch band. In order for it to be more effective, the location of the conductive connection provided by the via may be positioned to connect a downstream end of the resonance structure to a corresponding downstream end of the spiral arm segment so that the resonance structure co-extends with the spiral arm segment from the downstream end to an upstream end adjacent a corresponding upstream end of the spiral arm segment. It is appreciated that "downstream" and "upstream" are terms relative to signal propagation, where a signal source or feedpoint is considered upstream.

Multiple resonance structure structures may also be provided for each spiral arm to suppress multiple notch frequency bands. The multiple resonance structure structures do not all have to be on same side of spiral antenna; they may be located on either side of the spiral arm plane, with all on one side or the other, or some on one side and some on the other side.

Signal feed connections (e.g. balun) to the spiral antenna may be provided near the center of spiral arms at the radially inner ends thereof, no as to propagate radially outward. In the alternative, the feed connections may be provided at the radially outer ends of the spiral arms, so as to propagate radially inward. For center spiral connection, conventional feed arrangement may be orthogonal to the spiral plane. In this regard, mechanical support (e.g. support frame) may be provided for the orthogonal signal feed connection. Such mechanical support is particularly useful for the free-standing embodiment of the spiral antenna of the present invention.

DETAILED DESCRIPTION

Figure 1:
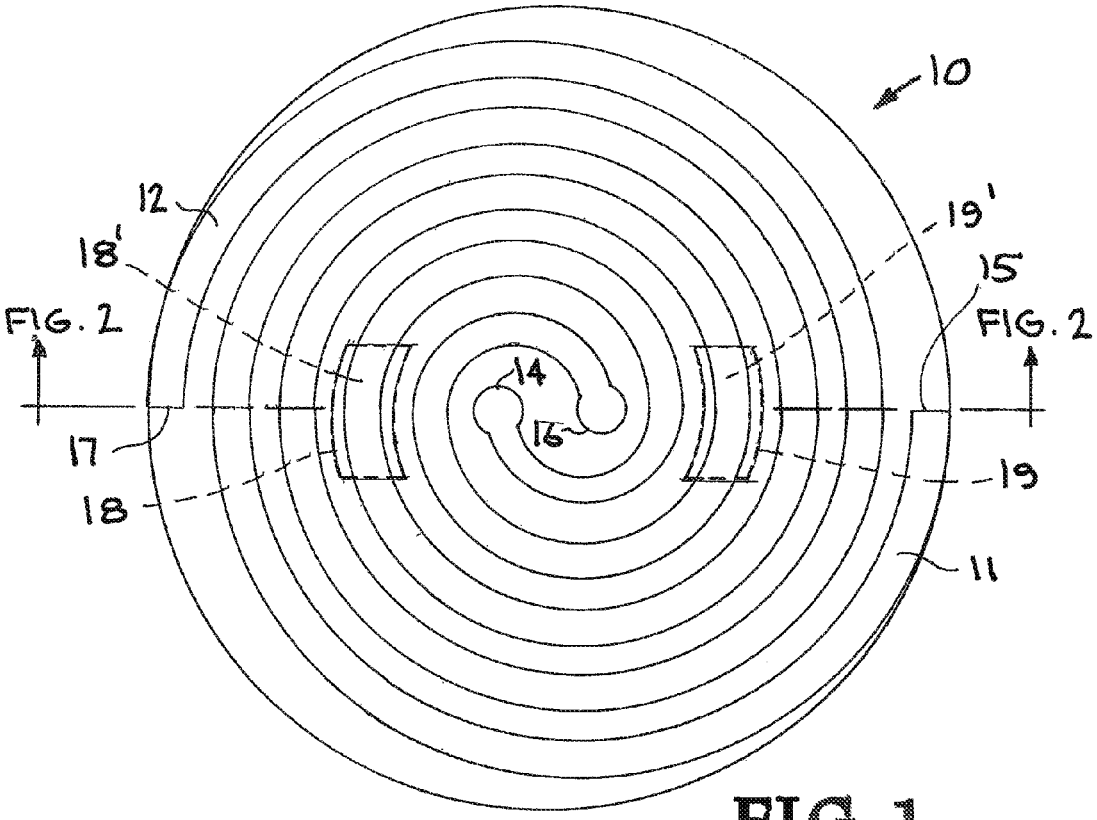
FIG. 1 shows a top view of a first example embodiment of the band-notched spiral antenna of the present invention.
Figure 2:
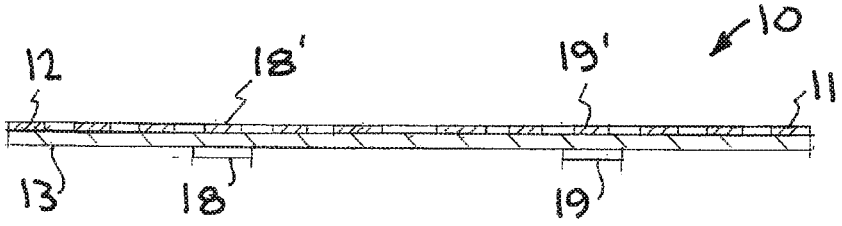
FIG. 2 shows a side cross-sectional view of the embodiment shown in FIG. 1.
Figure 3:
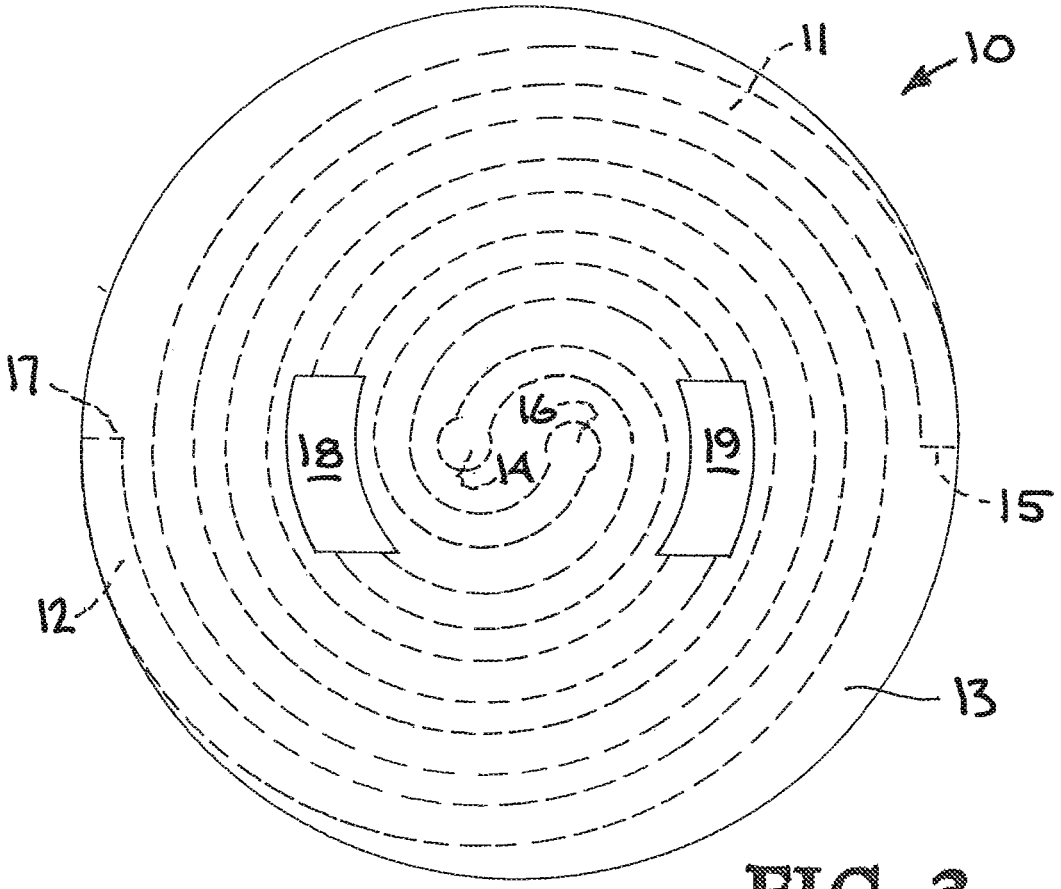
FIG. 3 shows a bottom view of the embodiment shown in FIGS. 1 and 2.

Turning now to the drawings, FIGS. 1-3 show a top view, side cross-sectional view, and bottom view, respectively, of a first example embodiment of the band-notched antenna of the present invention, generally indicated at reference character 10. In particular, the spiral antenna is shown having two spiral arms 11 and 12 formed on a surface of a substrate 13 shown as a circular disc, with arm 11 spirally extending from a radially inner end 14 to a radially outer end 15 and arm 12 spirally extending from a radially inner end 16 to a radially outer end 17. Radially inner ends 14 and 15 are shown adjacent each other near the center of the circular disc substrate 13, and radially outer ends 16 and 17 are shown opposite each other near the periphery of the circular disc substrate 13. And while not shown in the drawings, it is appreciated that the spiral arms 11 and 12 may be connected to electronics of a broadband system at either the radially inner ends or radially outer ends, such as by a balun structure in the case of a transmitter which provides a differential input signal.

A pair of resonant structures 18 and 19 is also shown formed on the substrate 13, but on an opposite side from the spiral arms 11 and 12. In particular, the structures 18 and 19 are positioned adjacent corresponding segments of 18' and 19', respectively, of the spiral anus 11 and 12, respectively, which have been pre-determined to be spiral arm sections associated with the transmission and/or emission of a notch frequency band. Furthermore, the structures 18 and 19 are each shown to have a partial spiral shape that is substantially similar to and co-extending substantially in parallel with the spiral arm segment. It can also be seen in FIGS. 1-3 that the resonance structures 18 and 19 are positioned adjacent the spiral arm segment so that an orthogonal projection of each resonance structure onto the spiral arm does not intersect other segments of the spiral arm radially adjacent (both in a radially inward and outward directions) to the spiral arm segment, as can be seen from the lack of overlap.

Figure 4:
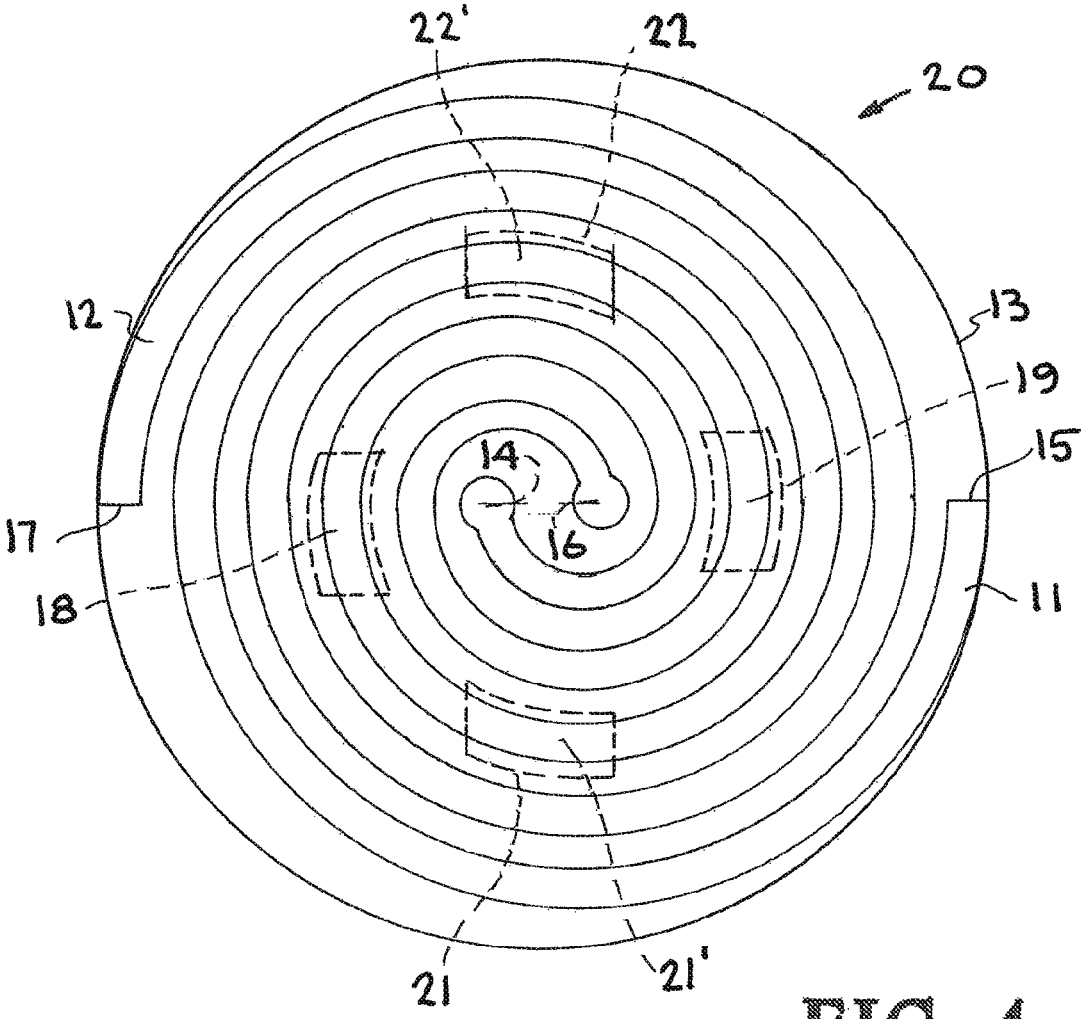
FIG. 4 shows a top view of a second example embodiment of the band-notched spiral antenna of the present invention.
Figure 5:
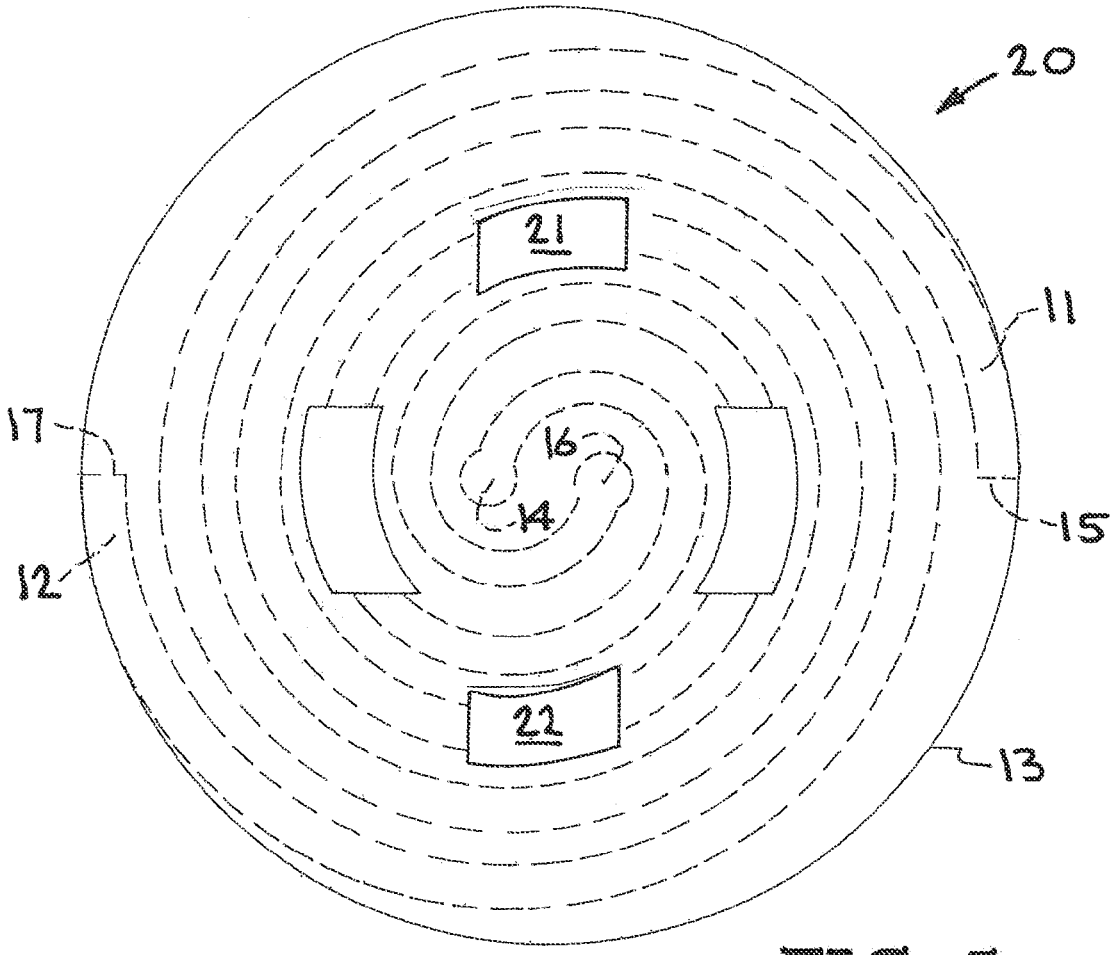
FIG. 5 shows a bottom view of the embodiment shown in FIG. 4.

The use of multiple resonant structures per spiral arm for notching multiple notch bands is shown by the example antenna embodiment in FIGS. 4 and 5, generally indicated at reference character 20. In particular, the spiral arms 11 and 12 of the antenna 20 is similar to the first embodiment of FIGS. 1-3, with both arms formed on the same side of substrate 13 and extending from radially inner ends 14 and 16 to radially outer ends 15 and 17, respectively. However, in addition to the pair of resonance structures 18 and 19 formed on the opposite side of substrate 13, an additional pair of resonance structures 21 and 22 are also provided on the substrate on the same side as the first pair of resonance structures 18 and 19. The second pair of resonance structures 21 and 22 are positioned adjacent additional segments 21' and 22' of the spiral arms 11 and 12, respectively, associated with a second notch frequency band to suppress. Thus, this embodiment provides at least one additional resonance structure each positioned adjacent another segment of the spiral arm associated with electromagnetic radiation of another notch frequency band of the frequency range so as to resonate and suppress electromagnetic radiation over said another notch frequency band.

Figure 6:
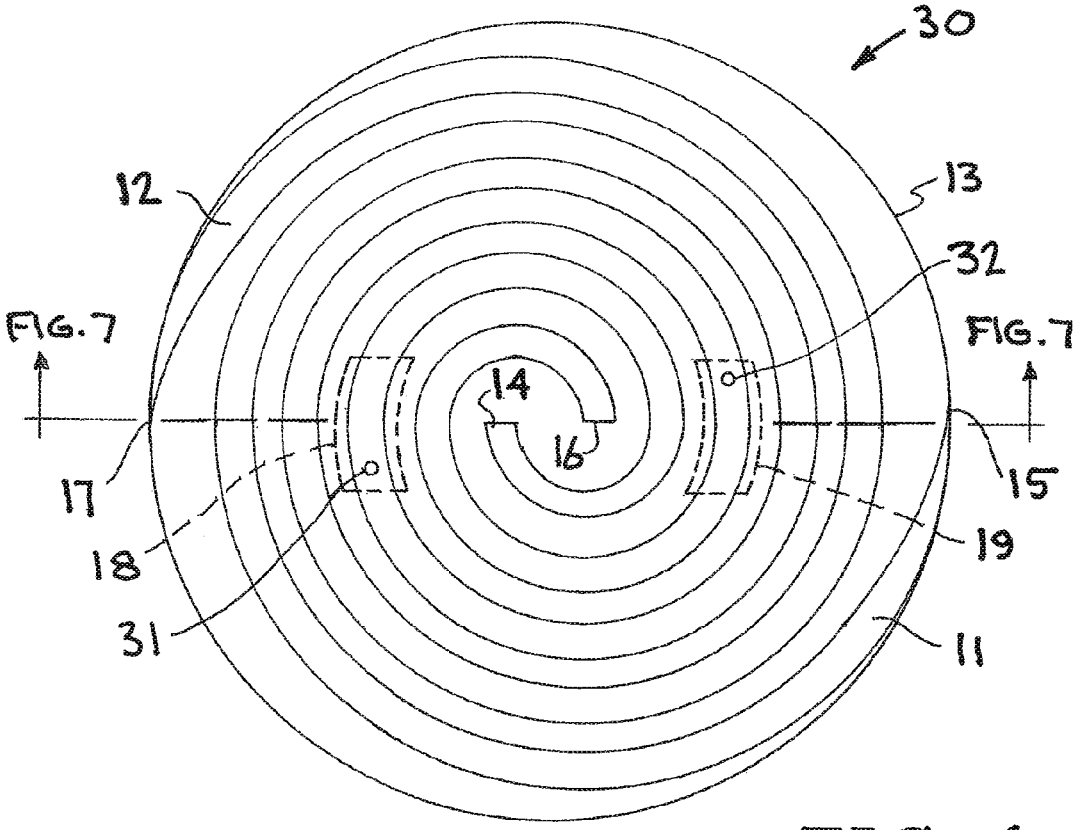
FIG. 6 shows a top view of a third example embodiment of the band-notched spiral antenna of the present invention.
Figure 7:
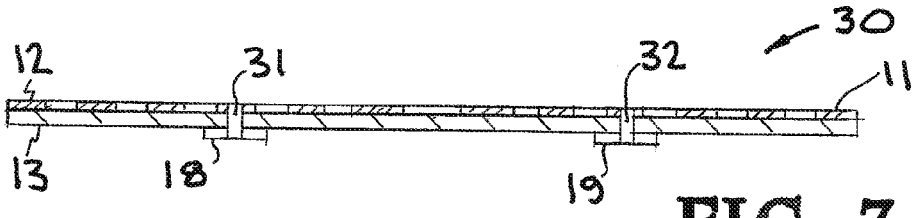
FIG. 7 shows a side cross-sectional view of the embodiment shown in FIG. 6.
Figure 8:
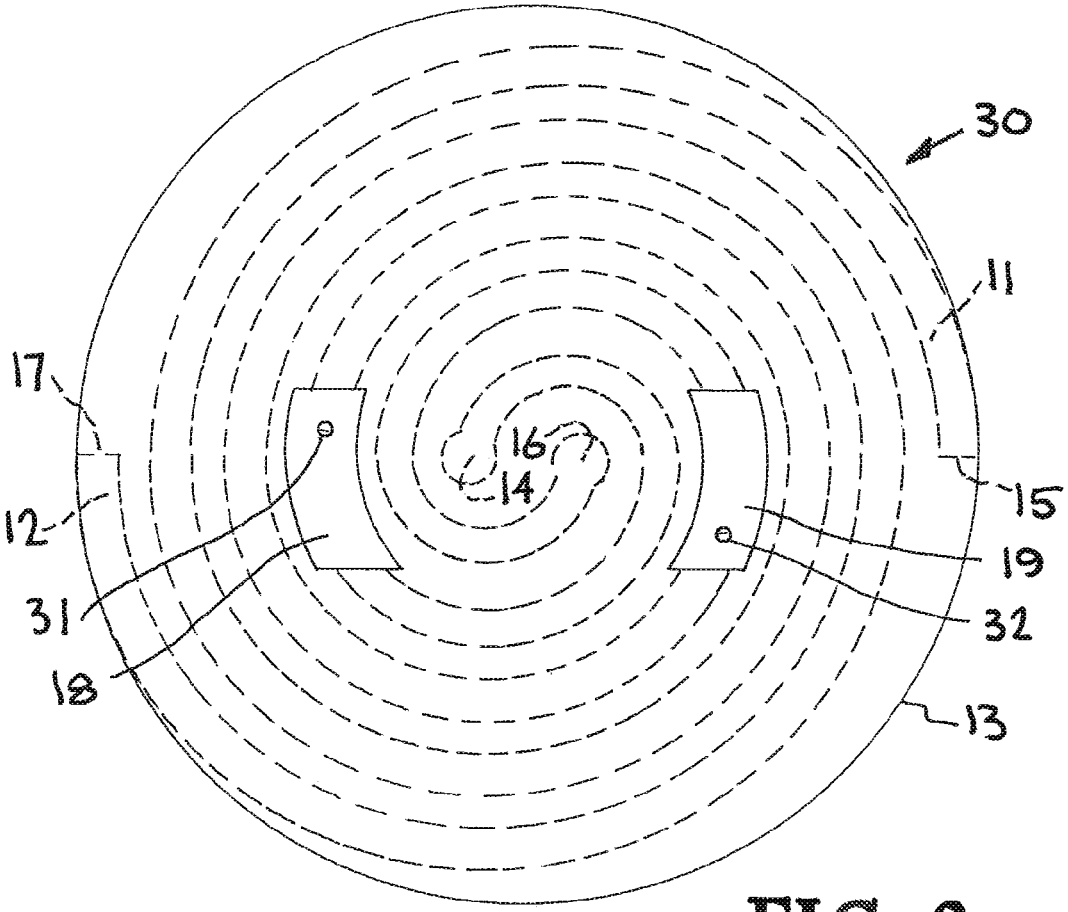
FIG. 8 shows a bottom view of the embodiment shown in FIGS. 6 and 7.

FIGS. 6-8 are similar to FIGS. 1-3 and show another embodiment having two spiral arms formed on a substrate with resonance structures 18 and 19. However, each of the resonance structures 18 and 19 is connected to its corresponding spiral arm segment 18' and 19' by means of electrically conductive vias, shown at 31 and 32. In particular, each of the vias are shown connecting a downstream end of the resonance structure to a corresponding downstream end of the spiral arm segment so that the resonance structure co-extends with the spiral arm segment from the downstream end to an upstream end adjacent a corresponding upstream end of the spiral arm segment. It is appreciated that if the resonance structure was positioned on the same side of the substrate as the spiral arms, then a standoff insulator could be used connecting between the resonance structure and the spiral arm segment.

Figure 9:
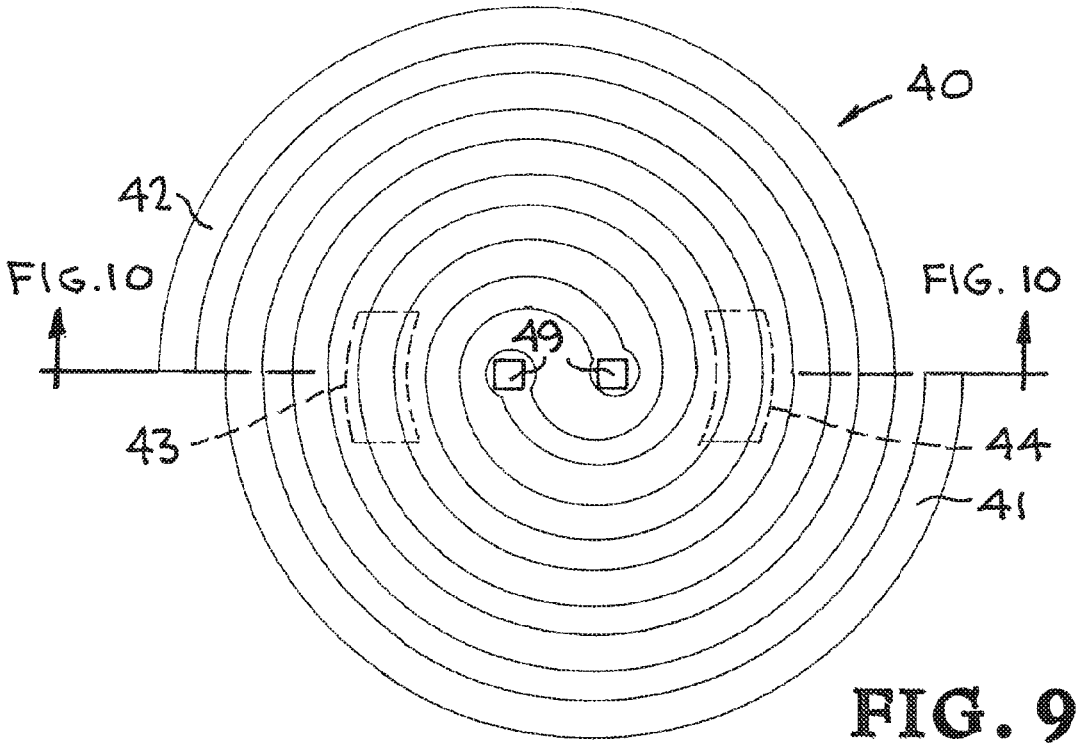
FIG. 9 shows a top view of a fourth example embodiment of the band-notched spiral antenna of the present invention.
Figure 10:
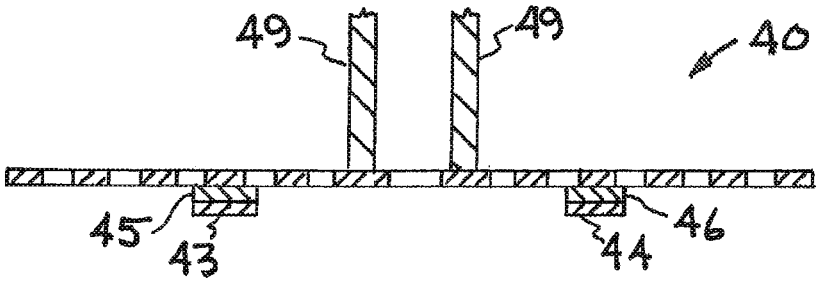
FIG. 10 shows a side cross-sectional view of the embodiment shown in FIG. 9.
Figure 11:
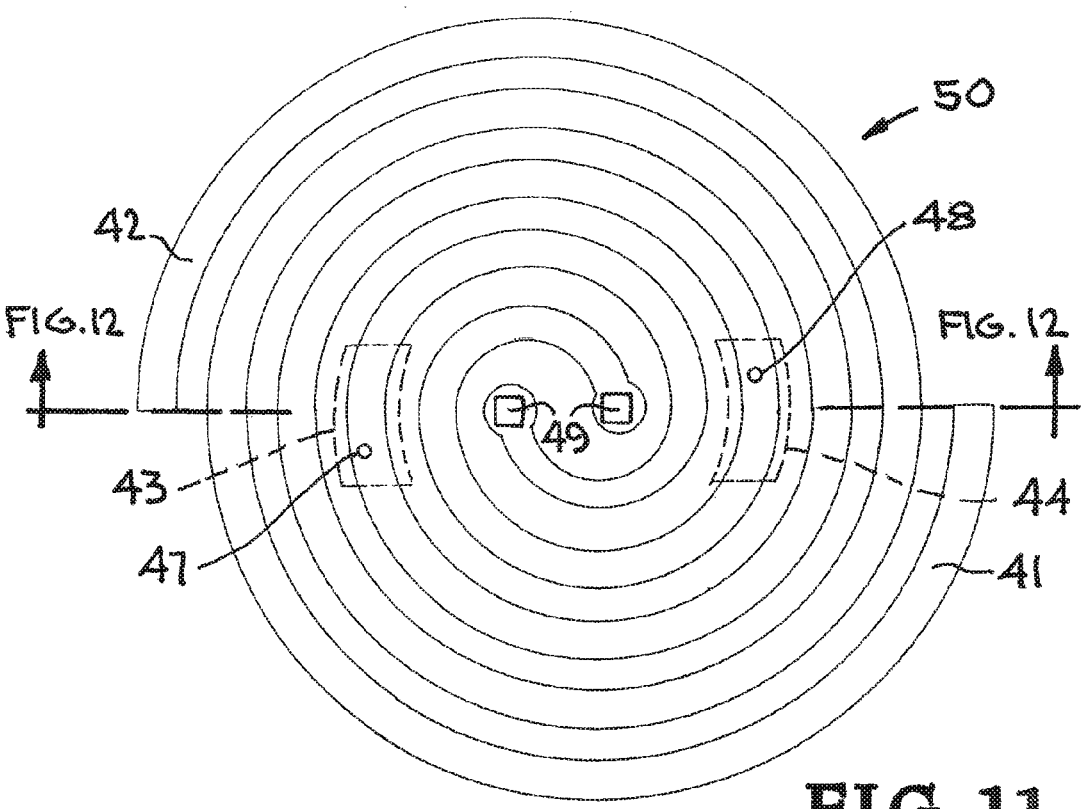
FIG. 11 shows a top view of a fifth example embodiment of the band-notched spiral antenna of the present invention.
Figure 12:
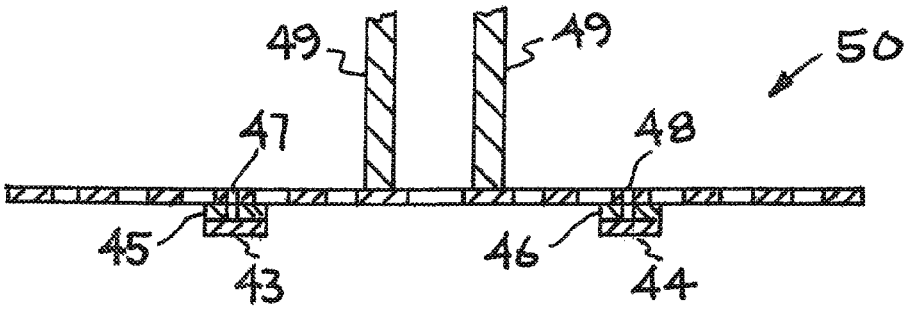
FIG. 12 shows a side cross-sectional view of the embodiment shown in FIG. 11.

FIGS. 9 and 10 are top and side cross-sectional views of another embodiment of the spiral antenna, generally indicated at 40, and having two spiral arms 41 and 42, with two resonance structures 43, 44. These figures illustrate that the spiral arms may be formed as free-standing structures without the use of a substrate. For this, a mechanical support may be provided by rigid electrical leads 49 connecting at either the radially inner ends or the radially outer ends which themselves have mechanical support. Because a substrate is not used, the resonance structures 43 and 44 are spaced from and connected to the spiral arms by means of standoff insulators 44 and 45. And FIGS. 11 and 12 are similar to FIGS. 9 and 10, respectively, with the addition of vias 47 and 48 electrically connecting the spiral arms segments with the resonance structures.

Figure 13:
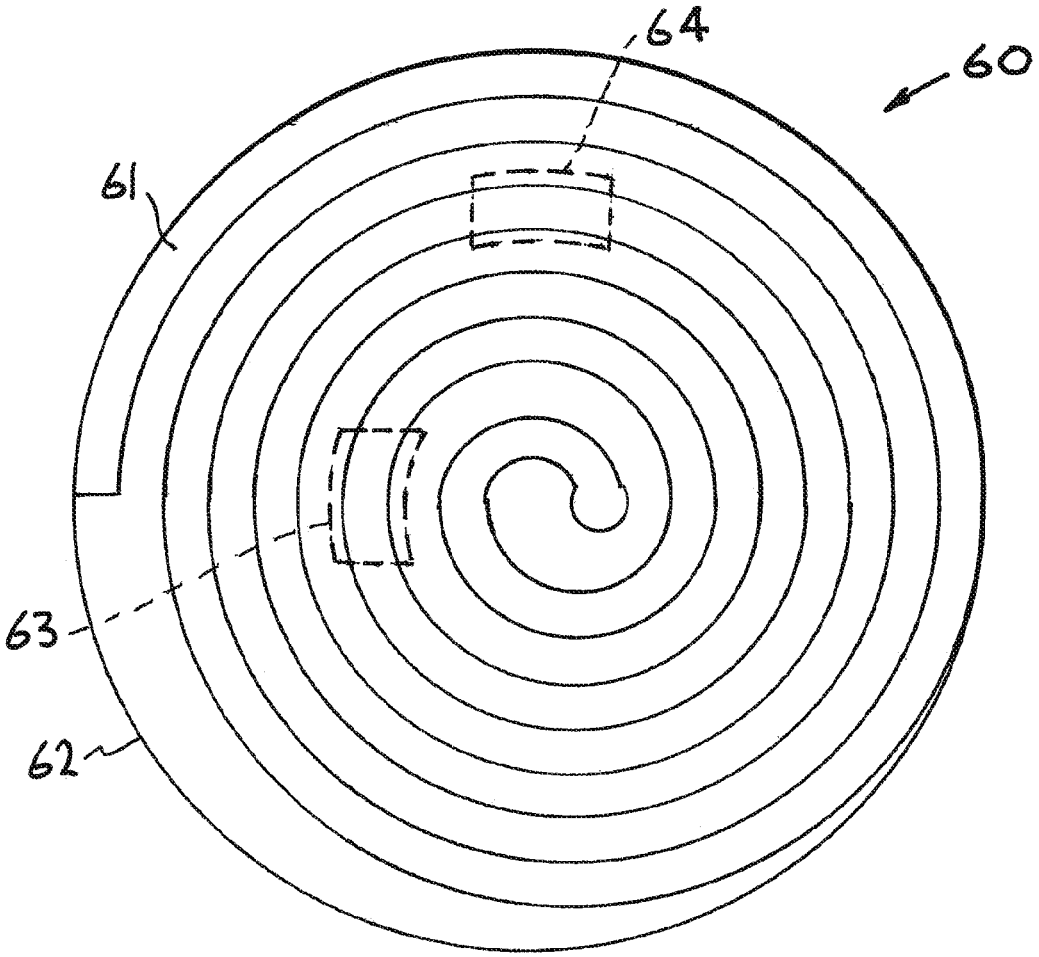
FIG. 13 shows a top view of a sixth example embodiment of the band-notched spiral antenna of the present invention.

FIG. 13 shows a single spiral arm embodiment of the present invention, generally indicated at 60 having a single spiral arm 61 and two resonance structures 63, 64. In particular, the single spiral arm is shown formed on a substrate 63. Similar to other embodiments the location of the resonance structures may be placed on either side of the substrate relative to the spiral arms.

Example Implementation: UWB Band-Notched at 5.15 to 5.825 GHz

FIGS. 14-20 show an example band-notched planar spiral antenna of the present invention that was fabricated on a substrate (i.e. a Duroid 5880 substrate from Rogers Corporation of Chandler, Ariz.) having a thickness of 0.79 mm. The antenna was designed for the FCC designated unlicensed ultra-wideband, which is 3.1 to 10.6 GHz.

In particular, the top layer of the substrate was printed with equiangular spiral geometry, and measured 5 cm across with four turns in each of the spiral arms. Width and the spacing between the spiral arms were kept to be the same dimension. Overall antenna is circular with a design radius of 3 cm. Based on the fact that tapered ends improve the impedance matching performance, region outside of the circular area covered by the radius to the inner edge of the arm has been cut away. Physical radius to the outer edge measures, 24.25 mm. Therefore the actual antenna spans just about 5 mm, as. Angular offset δ is kept at pi/2. The expansion rate is calculated to be 0.135. Inner diameter of the spirals is set to 2 mm. However the feed point gap is tapered toward the center until the gap reaches a 1 cm separation. Spiral makes four turns to extend the lower end of the operating frequency range to the point where the minimum feature size stays above the resolution limit of the PCB plotter used to fabricate the antenna. LPKF's S100 PCB prototyping machine was used for fabrication. With its tools designed for RF applications, machine is capable of realizing 0.2 mm trace and gap width. The minimum feature size for this antenna with the given parameters is 0.215 mm. The resonant structure is located at 2.11 turns to 2.4 turns with the same trace width as the top side.

Figure 17:
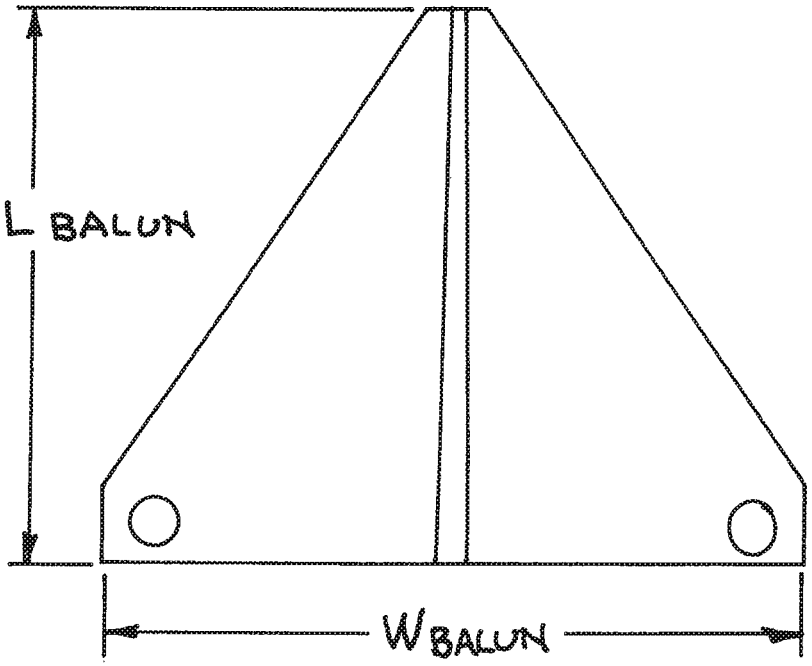
FIG. 17 shows a front view of the balun and mechanical support of the example model of FIG. 14.
Figure 18:
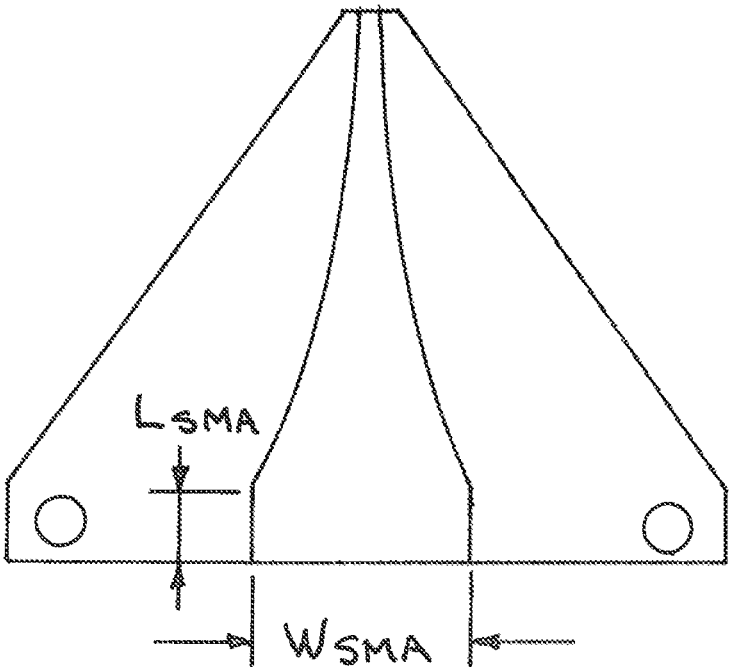
FIG. 18 shows a back view of the balun and mechanical support of the example model of FIG. 14.

Spiral antennas require a differential input. Consequently, an external wideband balun was designed to accompany and feed the antenna. Exponential taper microstrip balun was chosen for its relatively simplistic, and easily parameterizable dimensions. FIGS. 17 and 18 depict the balun design, and the mechanical support. It stretches 35 mm ($L_{balun}$) by 44 mm ($W_{balun}$). Same substrate as the antenna was used for balun construction as well. On top side of the substrate is a microstrip line that gradually changes from 50 Ohm width to the width that corresponds to the input impedance of the PESA for this particular substrate. On the bottom side is the ground plane to hold 50 ohm impedance at the feed point for the length that is equivalent to an end-launch SMA connector's ground prongs ($L_{SMA}$=5 mm, $W_{SMA}$=10 mm). Then it exponentially tapers to the width that corresponds to the input impedance of the PESA, eventually forming a parallel strip line with the top trace. This allows a gradual change of an unbalanced signal to a balanced signal. The length of the balun is chosen based on the half wavelength of the lowest operating frequency of the antenna. The size of the substrate outside of the signal traces was chosen based on the formation of the spirals to accommodate screw-hole alignment for mechanical stability. Two 4-40 screw size holes in the spiral and two more on the balun were drilled. L brackets, made out of delrin, are placed over these holes and nylon screws were used to hold them in place.

Figure 19:
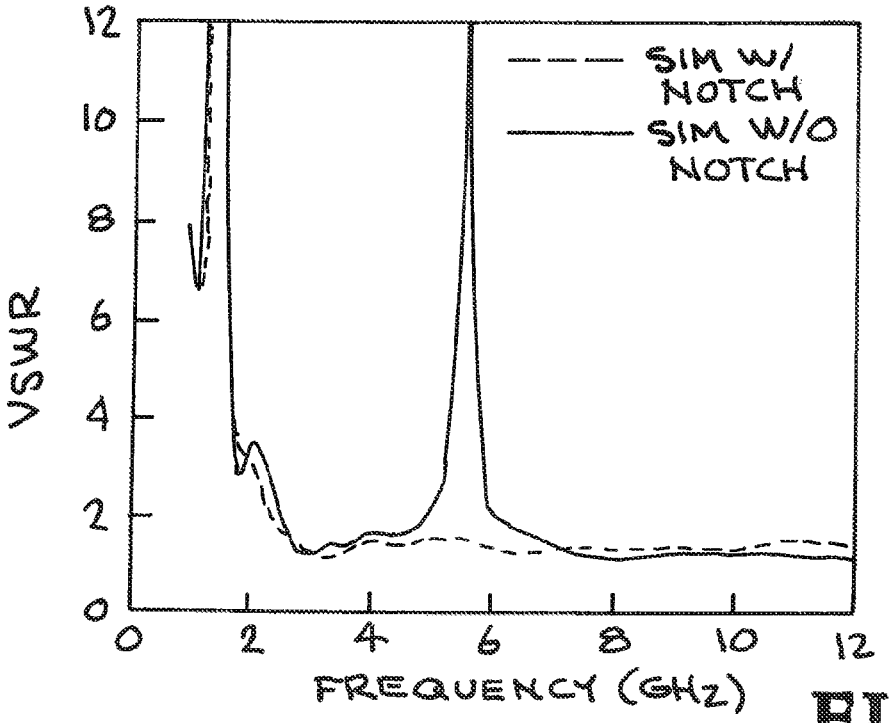
FIG. 19 shows a graph of impedance matching over frequency of the example model of FIG. 14.
Figure 20:
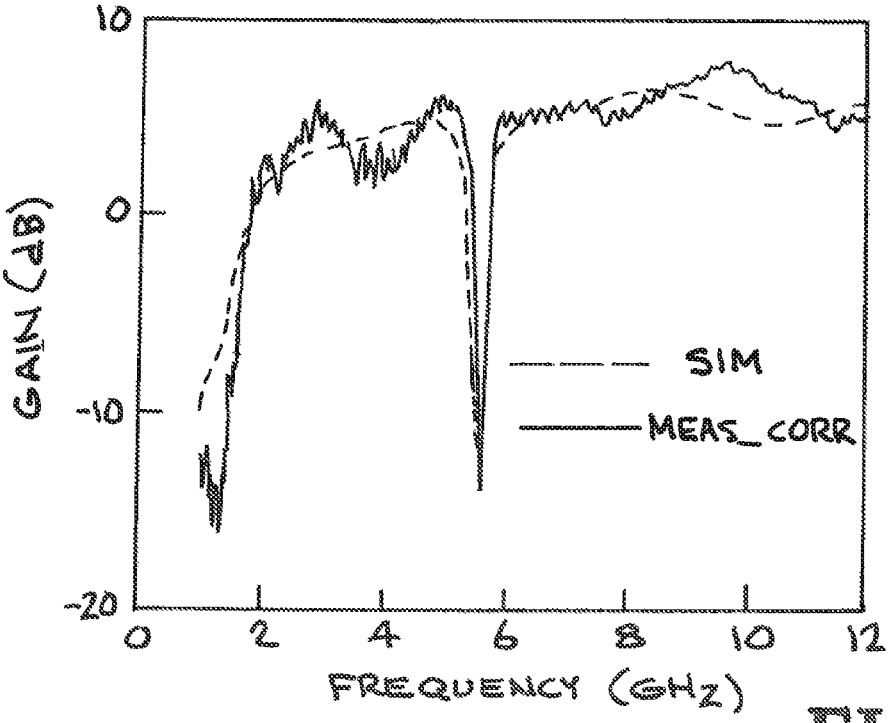
FIG. 20 shows a graph of gain profile over frequency of the example model of FIG. 14.

A resonant structure was formed on the bottom side to create a notch filter response over the targeted notch band, e.g. the 802.11a band, which is 5.15 to 5.85 GHz. VSWR of 2:1 is achieved for the FCC UWB band, which is 3.1 to 10.6 GHz. For the notch band, which is 5.15 to 5.85 VSWR exceeds 2:1, peak rejection reaching 12:1 at the center of the band at 5.5 GHz. As can be seen in FIG. 19, VSWR without the resonance structure is very low and flat across the entire band. When the resonance structure was added, a high rejection occurred at about 5.45 GHz, reaching 12:1 VSWR. A sharp drop in gain occurs at the mid frequency in the notch band as shown in FIG. 20. Suppression of radiation in this band is evident in its gain profile over frequency and in current density plot around the resonant structure as well. Simple control of two design parameters can readily move the notch band. The proposed antenna is fabricated on a Rogers Duroid substrate along with a custom designed balun. The simulation results are validated through experimental measurements.

Figure 14:
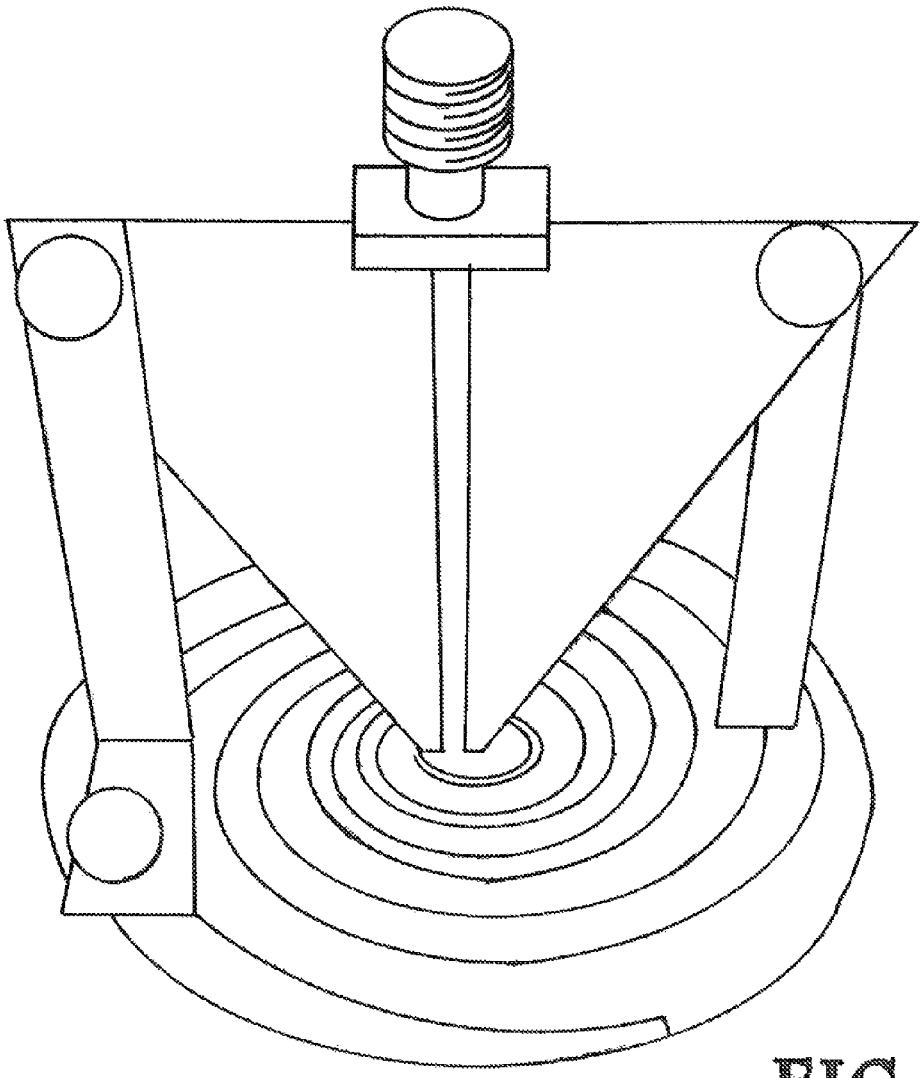
FIG. 14 shows a photo of an example model of the band-notched spiral antenna of the present invention, constructed with a balun with mechanical support.
Figure 15:
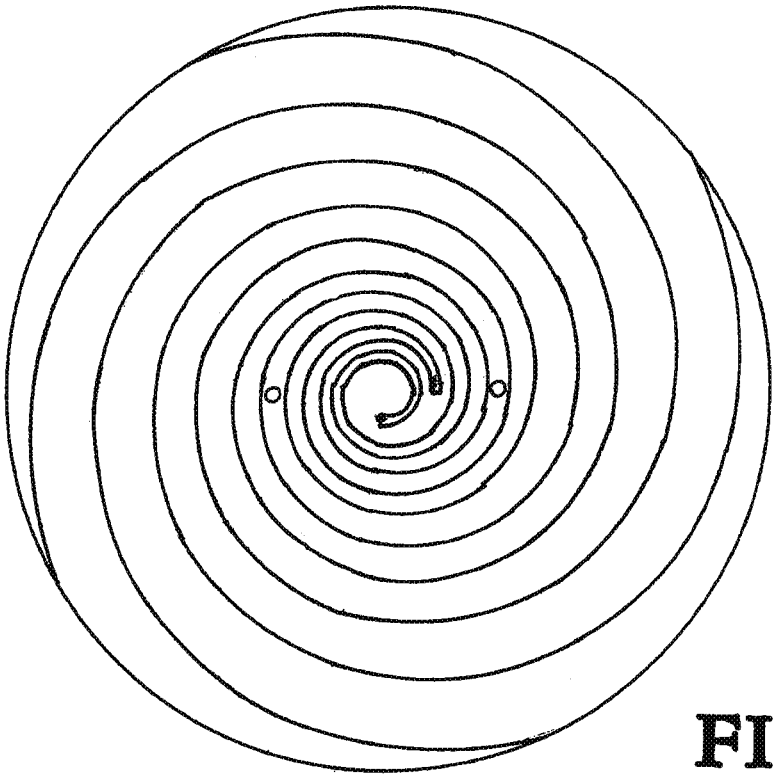
FIG. 15 shows a top view of the example model of FIG. 14.
Figure 16:
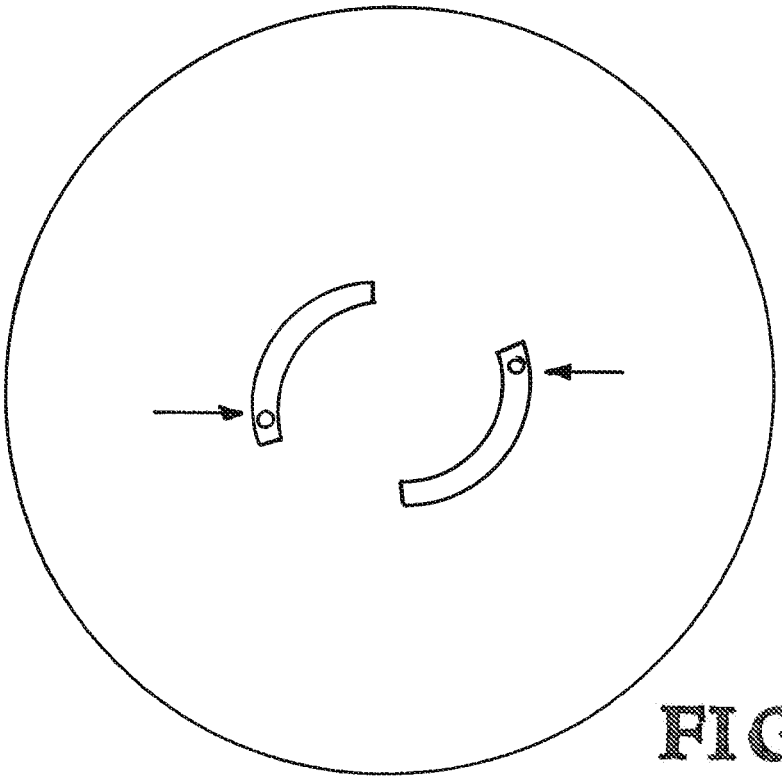
FIG. 16 shows a bottom view of the example model of FIG. 14.

An electromagnetic simulation package was used for simulation. Initially, simulation included the antenna portion only to reduce computation time. Spiral antennas require a balanced feed. A discrete port was used in the middle of the gap between where the spiral arms are the closest. A parametric study on the source impedance revealed that the input impedance of the spiral antenna is approximately around 100 Ohms. For the remainder of the simulation process, the source impedance was set to 100 Ohms. And it was checked regularly through the optimization process that the source impedance was at an optimal value. Number of turns, outer radius, length and location of the secondary structure were parameterized and were tuned until desired response was reached. Then the microstrip balun, which also serves as an impedance transformer was designed to preserve this performance while allowing an unbalanced feed from a 50 Ohm source. All simulation results presented in this paper include the balun in the simulation environment, oriented as shown in FIG. 14.

FIG. 19 shows the impedance matching of the antenna over frequency. Red curve is the return loss profile without the notch filter feature and the blue curve is with the notch filter feature. Spiral antenna without the notch filter has an excellent input impedance matching as expected. VSWR of 2:1 is comfortably met for the entire UWB band. Nearly flat S11 curve above 3 GHz, demonstrates self-complementary nature of the antenna. Also evident in FIG. 4, when the secondary resonant structure is added, mismatch is created at the desired frequency range, covering from 5 to 6 GHz. The peak rejection reaches 12:1 VSWR at 5.5 GHz. The resonant structure does not interfere with frequencies outside of this band as it is evident in the similarity in S11 outside of the notch band.

Gain profile over frequency, depicted in FIG. 20 is obtained from monitoring the far field radiation. The simulation result corresponds to the realized gain, which takes into account the losses at the input. Boresight is chosen for obtaining the data. As expected the gain curve is flat outside of the notch band and within the operating band. But clearly, there is a sharp drop in gain within the notch band. Two antennas, both from the second iteration where the frequency shift error has been accounted for, were set a meter apart inside a partial anechoic chamber. A network analyzer was used to measure the S21 response. Post processing was applied using the Friis transmission equation. The resultant measured gain curve solidly confirms the simulation result. The sharp drop in the gain in both results closely aligns. The slight fluctuation in the measured gain curve at the high end of the frequency range can be attributed to imperfect far-field environment for the test setup. Thus, measured result validated the simulation result, demonstrating that PESA can be a good alternative to planar monopoles with an advantage of having a circular polarization and higher directivity.

Although the description above contains many details and specifics, these should not be construed as limiting the scope of the invention but as merely providing illustrations of some of the presently preferred embodiments of this invention. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present invention fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

We claim:

1. A band-notched spiral antenna, comprising:

a spiral arm extending from a radially inner end to a radially outer end for transmitting or receiving electromagnetic radiation over a frequency range; and a resonance structure positioned adjacent a segment of the spiral arm by a standoff insulator connecting therebetween, said spiral arm segment associated with a notch frequency band of the frequency range and adapted to suppress the transmission or reception of electromagnetic radiation over said notch frequency band.

2. The band-notched spiral antenna of claim 1, wherein the resonance structure has a partial spiral shape co-extending substantially in parallel with the spiral arm segment.

3. The band-notched spiral antenna of claim 1, wherein the resonance structure is electrically connected to the spiral arm segment by an electrically conductive via.

4. The band-notched spiral antenna of claim 3, wherein the via connects a downstream end of the resonance structure to a corresponding downstream end of the spiral arm segment so that the resonance structure co-extends with the spiral arm segment from the downstream end to an upstream end adjacent a corresponding upstream end of the spiral arm segment.

5. The band-notched spiral antenna of claim 1, wherein the resonance structure is positioned adjacent the spiral arm segment so that an orthogonal projection of the resonance structure onto the spiral arm does not intersect other segments of the spiral arm radially adjacent to the spiral arm segment.

6. The band-notched spiral antenna of claim 1, further comprising:

at least one additional resonance structure each positioned adjacent another segment of the spiral arm by a standoff insulator connecting therebetween, said another spiral arm segment associated with electromagnetic radiation of another notch frequency band of the frequency range and adapted to suppress electromagnetic radiation over said another notch frequency band.

7. The band-notched spiral antenna of claim 1, further comprising:

at least one additional spiral arm extending between the other spiral arm(s) from a radially inner end to a radially outer end; and for each additional spiral arm, a resonance structure positioned adjacent a segment of the additional spiral arm by a standoff insulator connecting therebetween, said segment of the additional spiral arm associated with electromagnetic radiation of said notch frequency band and adapted to suppress the transmission or reception of electromagnetic radiation over said notch frequency band.

8. The band-notched spiral antenna of claim 7, further comprising:

for each spiral arm, at least one additional resonance structure each positioned adjacent another segment of said spiral arm by a standoff insulator connecting therebetween, said another spiral arm segment associated with electromagnetic radiation of another notch frequency band of the frequency range and adapted to suppress electromagnetic radiation over said another notch frequency band.

9. The band-notched spiral antenna of claim 1, wherein the standoff insulator is a substrate for supporting the spiral arm and the resonance structure thereon.

10. The band-notched spiral antenna of claim 9, wherein the resonance structure is formed on an opposite side of the substrate from the spiral arm.

11. A band-notched spiral antenna, comprising:

two spiral arms extending between a radially inner end to a radially outer end for transmitting or receiving electromagnetic radiation over a frequency range; and for each spiral arm, a resonance structure having a partial spiral shape positioned adjacent to and co-extending substantially in parallel with a segment of the spiral arm by a standoff insulator connecting therebetween, said spiral arm segment associated with electromagnetic radiation of a notch frequency band of the frequency range and adapted to suppress electromagnetic radiation over said notch frequency band.

12. The band-notched spiral antenna of claim 11, wherein for each spiral arm the resonance structure is electrically connected to the spiral arm segment by an electrically conductive via.

13. The band-notched spiral antenna of claim 12, wherein for each spiral arm the via connects a downstream end of the resonance structure to a corresponding downstream end of the spiral arm segment so that the resonance structure co-extends with the spiral arm segment from the downstream end to an upstream end adjacent a corresponding upstream end of the spiral arm segment.

14. The band-notched spiral antenna of claim 11, wherein for each spiral arm the resonance structure is positioned adjacent the spiral arm segment so that an orthogonal projection of the resonance structure onto the spiral arm does not intersect other segments of the spiral arm radially adjacent to the spiral arm segment.

15. The band-notched spiral antenna of claim 11, further comprising:

for each spiral arm, at least one additional resonance structure each positioned adjacent another segment of the spiral arm by a standoff insulator connecting therebetween, said another spiral arm segment associated with electromagnetic radiation of another notch frequency band of the frequency range and adapted to suppress electromagnetic radiation over said another notch frequency band.

16. The band-notched spiral antenna of claim 11, wherein the standoff insulator is a substrate upon which the spiral arms and the resonance structures are formed.

17. The band-notched spiral antenna of claim 16, wherein the resonance structures are formed on an opposite side of the substrate from the spiral arm.

18. A band-notched spiral antenna, comprising:

a substrate;

at least two spiral arms formed on the substrate and extending between a radially inner end to a radially outer end for transmitting or receiving electromagnetic radiation over a frequency range; and for each spiral arm, at least two resonance structures formed on an opposite side of the substrate from the spiral arms, with each resonance structure having a partial spiral shape positioned adjacent to and co-extending substantially in parallel with a corresponding one of at least two spiral arm segments by a standoff insulator connecting therebetween, said at least two spiral arm segments associated with electromagnetic radiation of at least two notch frequency bands of the frequency range and adapted to suppress electromagnetic radiation over said at least two notch frequency bands.

* * * * *